United States Patent [19]

Shaw

[11] 4,343,267

[45] Aug. 10, 1982

[54] CYLINDER BLOCK FOR AN INTERNAL COMBUSTION ENGINE

[75] Inventor: Terrence M. Shaw, Columbus, Ind.

[73] Assignee: Cummins Engine Company, Inc., Columbus, Ind.

[21] Appl. No.: 99,535

[22] Filed: Dec. 3, 1979

[51] Int. Cl.[3] ..... F02F 1/10

[52] U.S. Cl. ..... 123/41.81; 123/41.74

[58] Field of Search ..... 123/41.72, 41.74, 193 C, 123/41.81

[56] References Cited

U.S. PATENT DOCUMENTS

| | | | |
|---|---|---|---|
| 1,292,634 | 1/1919 | Opperman | 123/41.81 |
| 1,416,170 | 5/1922 | Cattaneo | 123/41.81 |
| 1,597,706 | 8/1926 | Aldous | 123/41.74 |
| 2,054,926 | 9/1936 | Caminez et al. | 123/41.74 |
| 2,713,332 | 7/1955 | Beardsley | 123/41.74 |
| 3,173,407 | 3/1965 | Sampietro et al. | 123/41.81 |

*Primary Examiner*—Craig R. Feinberg
*Assistant Examiner*—W. R. Wolfe
*Attorney, Agent, or Firm*—Neuman, Williams, Anderson & Olson

[57] ABSTRACT

An improved cylinder block for a high compression internal combustion engine is provided which includes a cooling jacket having interconnected peripheral side and end walls and a base section, and at least one cylinder tube disposed within and encompassed by the jacket wall. The tube extends upwardly from and is connected to the jacket base section. The upper end portion of the tube adjacent the top surface of the block is reinforced by a plurality of substantially radial supports extending from the tube exterior to the interior surface of the jacket wall. The supports provide substantial radial reinforcement as compared to vertical reinforcement of the tube, particularly in the area thereof which is subjected to the greatest pressure during operation of the engine.

6 Claims, 7 Drawing Figures

FIG. 1 (PRIOR ART)
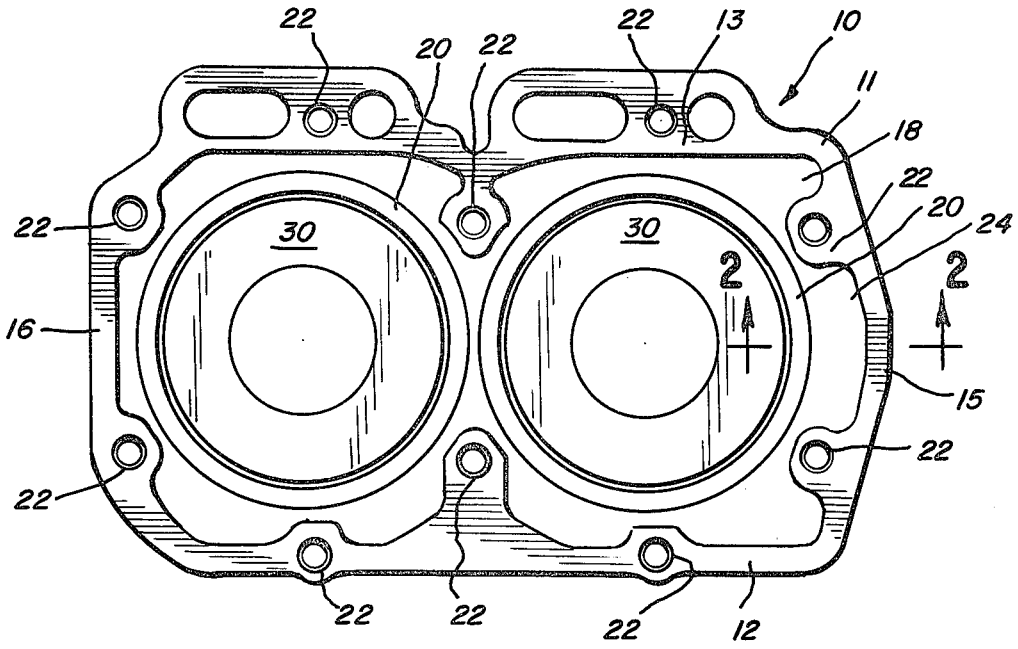
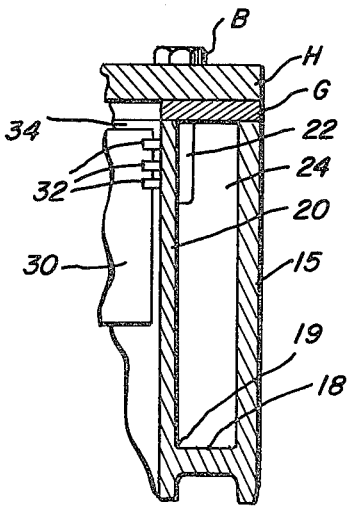
FIG. 2 (PRIOR ART)

FIG. 3 (PRIOR ART)
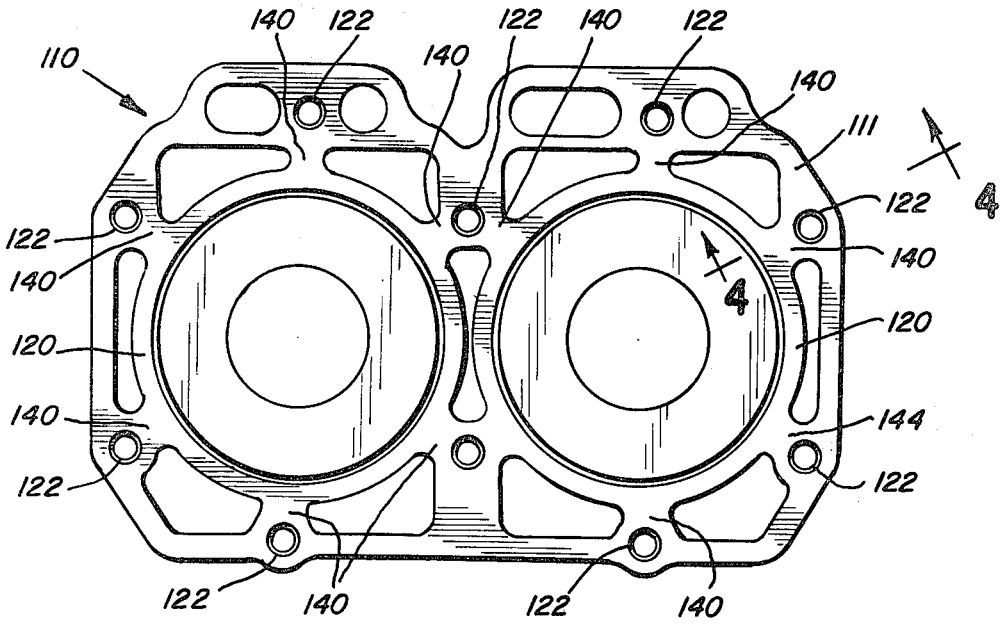
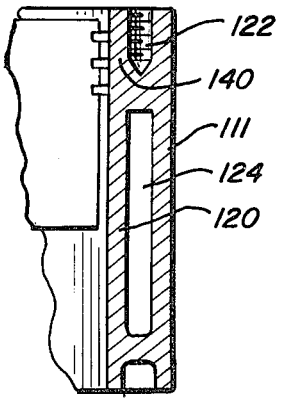
FIG. 4 (PRIOR ART)

FIG. 5
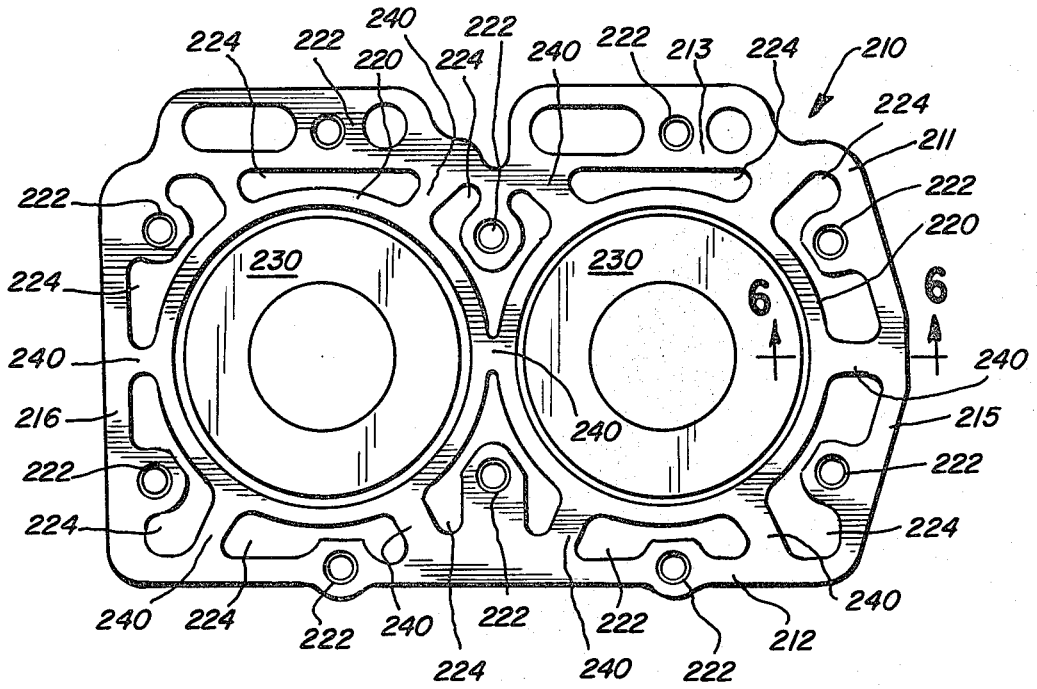
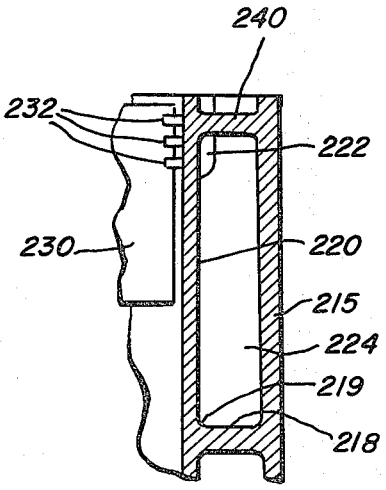
FIG. 7
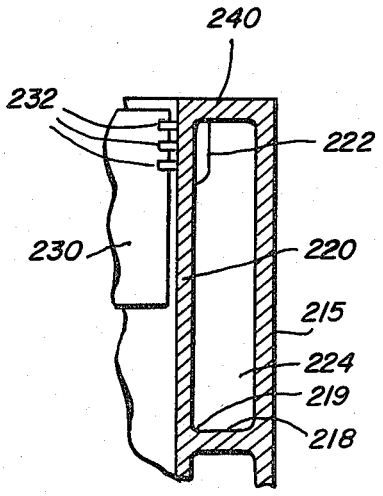
FIG. 6

CYLINDER BLOCK FOR AN INTERNAL COMBUSTION ENGINE

BACKGROUND OF THE INVENTION

In a typical top cored engine block construction, the cylinder tubes formed therein are substantially independent of the surrounding block structure, except for the attachment of each tube to the base, or floor, section of the surrounding cooling jacket. The block, including the cylinder tubes as well as the walls and floor section forming the cooling jacket therefor, is normally a one-piece casting. Heretofore, when machining and boring such a block, the compliance of the free-standing cylinder tubes caused serious cantilever and ring-type distortions. In an efford to reduce the seriousness of such distortions, radially extending stiffening supports (sometimes referred to as webs or struts) were frequently incorporated in the block which extended from the exterior of the tubes to head bolt bosses, the latter being located in close proximity to the tubes. Such supports were normally short and relatively thick and, thus, were very stiff or rigid in both the vertical and radial directions. Furthermore, the configuration of such supports oftentimes seriously impeded flow of the coolant through the cooling jacket which in turn impaired efficient operation of the engine.

Because of the stiffness of the supports, particularly in the vertical (axial) direction relative to the tubes, substantial distortions nevertheless developed in the tube walls when the cylinder head was drawn up tight on the top surface of the block to produce the necessary combustion seal for each of the engine cylinders. Because of such distortions, distribution of the seal load could not be uniformly effected.

Besides the shortcomings associated with the stiffness of the radial supports, oftentimes the locations of such supports relative to the exterior of the cylinder tubes did not effectively impede outward distortion of the tube wall in the area where the greatest internal pressure was generated during operation of the engine. By reason of this latter distortion, which normally occurred in the vicinity of the top combustion ring of the piston head when the latter was disposed at its top dead center, fretting and wear of the combustion seal by the cylinder tubes was increased thereby significantly shortening the useful life of such seal.

SUMMARY OF THE INVENTION

Accordingly, it is an object of the present invention to provide an improved cylinder block which readily avoids the aforenoted problems.

It is a further object to provide an effective support for the cylinder tubes within an engine block while at the same time permitting adequate coolant circulation through the cooling jacket formed in the block.

It is a further object to provide an improved cylinder block wherein accurate machining and boring thereof is facilitated by reason of the tube support embodied within the block itself.

It is a still further object of the invention to provide an improved cylinder block construction which may be readily incorporated in various size internal combustion engines.

Further and additional objects will become apparent from the description, accompanying drawings, and appended claims.

In accordance with an embodiment of the invention, a cylinder block for an internal combustion engine is provided which includes a cooling jacket having side walls and a floor section. At least one cylinder tube is disposed generally within the jacket and extends upwardly from and is connected to the jacket floor section. A plurality of circumferentially spaced radial supports extend outwardly from the exterior of the tube and connect same to either the surrounding jacket walls or an adjacent tube. The supports are isolated from the jacket floor section and any protrusions formed within the interior of the jacket, thereby maximizing the length of the supports and permitting coolant circulation throughout the jacket. The attachment of the supports to the exterior of the tubes is in the vicinity of the tube wall where the greatest internal pressure occurs during operation of the engine.

BRIEF DESCRIPTION OF THE DRAWINGS

FIG. 1 is a top plan view of one form of a prior art cylinder block.

FIG. 2 is a fragmentary sectional view taken along line 2—2 of FIG. 1 and showing a conventional head gasket and cylinder head secured to the prior art block by a plurality of head bolts.

FIG. 3 is a top plan view of a second form of a prior art cylinder block.

FIG. 4 is a fragmentary sectional view of the second form of a prior art cylinder block taken along line 4—4 of FIG. 3.

FIG. 5 is a top plan view of one form of the improved cylinder block.

FIG. 6 is a fragmentary sectional view of the improved cylinder block of FIG. 5 taken along line 6—6 of FIG. 5.

FIG. 7 is a fragmentary sectional view similar to FIG. 6 but showing an alternate embodiment of the improved cylinder block.

DESCRIPTION OF THE ILLUSTRATED EMBODIMENT

Referring now to FIGS. 1–2, one form of a typical prior art cylinder block 10 for an internal combustion engine is shown which is normally a one-piece casting and includes a cooling jacket 11 defined by opposing side walls 12 and 13, opposing end walls 15 and 16, and a floor section 18. One or more cylinder tubes 20 are disposed within the jacket 11 and extend upwardly from the floor section 18 at junction 19. A plurality of upwardly extending bosses 22 are provided within the block. Some of the bosses are located on the upper portion of the cooling jacket walls and others inwardly of the walls. The bosses are spaced generally circumferentially about the portion of the tubes 20 extending upwardly from the floor section 18. Each boss 22 is bored and internally threaded so as to engage the shank of a cylinder head bolt B, see FIG. 2. Except for a gasket G, to be described hereinafter, there are usually no other connections between the cylinder tube 20 and the jacket walls, the bosses or between adjacent tubes. Thus, in the prior art block 10 of FIGS. 1 and 2, the tubes 20 thereof are highly susceptible to cantilever and ring-type distortions during machining and boring of the block.

The space 24 formed between the cylinder tubes 20 and the cooling jacket walls is usually filled with a coolant typically water, which transfers excess heat to an external heat exchanger, not shown, as the coolant is pump circulated through the jacket and around the tubes.

A piston 30 is mounted for reciprocal movement within each tube 20 and includes one or more piston ring assemblies 32 which are disposed within grooves formed in the exterior of the piston head. The ring assemblies 32 bear outwardly against the interior of the cylinder tube or liner, whichever the case may be, to form gas tight and oil tight seals between the piston 30 and cylinder tube 20. The presence or absence of a cylinder liner is optional and does not alter the scope of the instant invention.

As noted in FIG. 2, the top surface of the prior art block 10 has assembled thereon a conventional gasket G and a cylinder head H overlying the gasket G. A plurality of cylinder head bolts B, one for each head bolt bore, compress the head H and gasket G against the top surface of the block 10 to form the sealed space 24 of the cooling jacket 11, and a combustion chamber 34, the latter being defined by the interior surfaces of the upper portion of the cylinder tube (or liner) 20, the crown surface of the piston head 30, and cylinder head H. The uppermost ring assembly 32 carried by the piston head 30 is intended to prevent blow-past of the combustion gases during operation of the engine. The pressures developed within the combustion chamber are normally of such a magnitude as to cause the portion of the cylinder tube wall in the vicinity of the uppermost ring assembly, when the piston head is at its top dead center, to deform radially outwardly. Such wall deformation results in angular deflections of the top edge of the tube wall and promotes serious fretting and excessive wear of the gasket G shortening its useful life as a seal for the combustion chamber. In addition, the repetitive deflections of the tube wall produce excessive strain or fatigue to the tube itself and enhances the possibility of a major engine failure.

As shown in FIGS. 3 and 4, various prior art attempts to overcome these deficiencies have involved radially oriented supports 140 being formed in the cylinder block 110 which connect the tops of the cylinder tubes 120 to the adjacent cylinder head bolt bosses 122. The bosses 122 and the supports 140 are typically integrally cast within the jacket 111. Although the supports 140 provide substantial support for the tubes, such benefits are outweighed by several disadvantages. For example, the supports are of such configuration that they reduce the coolant flow particularly in the area of the bolt bosses and near the tops of the cylinder tubes 120, where combustion temperatures are extreme. Because of the proximity of the bolt bosses 122 to the tubes 120, the supports 140 are very short, resulting in an undesirable stiffness in the axial, or vertical, direction. This stiffness results in nonuniform axial compliance of the cylinder tubes, causing substantial distortions of the cylinder tube wall when the combustion seal pressure is applied. The supports usually have a large diameter or thickness due to the casting consideratiions resulting from the proximity of the cylinder tube to the head bolt bosses. As a result of the support stiffness, the combustion seal load distribution effected when the cylinder head is assembled on the block 110, is nonuniform, resulting in seal efficiency degradation, and accelerated wear of the head gasket.

One embodiment of the improved cylinder block 210 embodying the present invention is illustrated in FIGS. 5–7. As in the case of prior blocks of this general type, block 210 is a single casting and includes a cooling jacket 211 having interconnected side and end walls 212, 213 and 215, 216, and a floor section 218. At least one cylinder tube 220 is disposed within the jacket 211 and extends upwardly from the floor section 218 and is conncted thereto at junction 219. A plurality of head bolt bosses 222 are located on the upper portion of the jacket walls and are in spaced partially encompassing relation with respect to tubes 220. Certain of the bosses, if desired, may be located on the interior or exterior of the jacket 211. Each of these bosses 222 is top cored or bored and internally threaded to engage the threaded shank of a corresponding cylinder head bolt when the cylinder head and gasket are assembled on the top surface of the block as described earlier. In the illustrated embodiment of the improved block 210 six head bolt bosses are shown in close proximity to the tubes, but the number of head bolts and corresponding bosses may be varied as desired.

The spaces 224 between the cylinder tubes 220 and the walls of the cooling jacket 211 are preferably interconnected and provide a continuous coolant flow path from one end of the block to the other. The size, shape and length of the flow path may vary depending upon engine design. A coolant, typically water, is circulated by a pump, not shown, through the spaces 224 and is transferred to an external heat exchanger, not shown. To maximize this heat exchange, it is desirable that the spaces 224 be as unobstructed as possible so that the coolant may freely flow around the tubes 220, and most notably in the vicinity of the top of the cylinder tubes.

A piston 230, each including one or more piston ring assemblies 232, is disposed for reciprocal movement within each tube 220.

A plurality of radial supports 240 are cast in block 210 and extend outwardly from the top portion of each cylinder tube to either the surrounding wall of the cooling jacket 211 or to an adjacent cylinder tube. The supports 240 are isolated from the bolt bosses 222 and provide the desired radial support to minimize the boring, milling, and combustion pressure distortions, yet the lengths of the supports result in axial compliance through bending and shear deflection. The axial compliance minimizes cylinder tube wall distortions and provides a more uniform combustion seal load distribution to enhance seal efficiency and life.

The supports 240 are preferably axially located near the top of the cylinder tube, as seen in FIG. 7, and each has a diameter or thickness approximating the cylinder tube wall thickness. The preferred axial location of each support is in the vicinity of the uppermost ring 232 encompassing the piston head 230 when the latter is at its top dead center within the cylinder tube. Locating the supports at such axial locations provides maximum radial support against distortions from machining and also significantly reduces outward bulging or distortion of the tube wall caused by the high pressures generated within the combustion chamber during operation of the engine. The location of the supports at, or near, the top of the tube also permits maximum coolant flow because of the relatively small diameter, or thickness, of the supports and their isolation from cylinder head bolt bosses and the floor section.

These supports, as aforementioned, are cast simultaneously with the cylinder block, add little weight, and are beneficial to cylinder tubes during machining of the block.

While the invention has heretofore been described in detail with particular reference to illustrated embodiments, it is to be understood, of course, that variations, modifications, and the substitution of equivalent mechanisms can be effected without departing from the scope of this invention.

What is claimed is:

1. A cylinder block for a reciprocating piston internal combustion engine comprising a cooling jacket defined by a continouous side wall and a floor section subtending same; at least one cylinder tube having a wall of predetermined thickness as measured along a radius extending from an interior of the tube wall to an exterior of the tube wall and being connected to and extending upwardly from said floor section and surrounded by said jacket, said cylinder tube being substantially axially supported only by the jacket floor section and substantially radially supported only by a plurality of independent circumferetially spaced radially extending supports connecting the exterior of said tube wall to an adjacent portion of the jacket side wall, the cylinder tube being substantially isolated from said jacket but for the supports and jacket floor section, said supports being disposed adjacent the uppermost end of said tube where the piston assumes a top dead center position, each support in transverse cross section with respect to a longitudinal axis having a width and thickness of substantially the same dimension as the cylinder tube wall thickness, wherein said supports resists radial deflection yet are axially compliant to minimize distortions when a cylinder head is compressed against the uppermost end of the cylinder tubes to form a combustion seal.

2. A cylinder block as in claim 1 wherein a plurality of head bolt bosses are disposed within said jacket and are adjacent to but spaced from the exterior of said tube, said bosses being isolated from said supports.

3. A cylinder block as in claim 1 having a plurality of cylinder tubes and wherein the tubes are interconnected by supports, the tubes being substantially isolated from each other but for the supports.

4. A cylinder block as in claim 1 or 3 wherein said cooling jacket includes a substantially continuous coolant flow path extending substantially the length of said block.

5. A cylinder block as in claim 1 wherein the top of a predetermined number of supports are recessed from a plane encompassing the top surface of the cylinder block and the upper end of the cylinder tube.

6. A cylinder block as in claim 5 wherein a portion of each support is adjacent the location of maximum outward radial deflection of said tube wall when the engine is operating.

* * * * *

UNITED STATES PATENT AND TRADEMARK OFFICE

CERTIFICATE OF CORRECTION

PATENT NO. : 4,343,267
DATED : August 10, 1982
INVENTOR(S) : Terrence M. Shaw

It is certified that error appears in the above-identified patent and that said Letters Patent are hereby corrected as shown below:

Column 1, line 16 - "efford" should be -- effort --

Column 2, line 67 - "coolant" should be -- coolant, --

Column 3, line 58 - "consideratiions" should be -- considerations --

Column 5, line 17 - "circumferetially" should be -- circumferentially --

Signed and Sealed this

Fourth Day of January 1983

[SEAL]

Attest:

GERALD J. MOSSINGHOFF

Attesting Officer

Commissioner of Patents and Trademarks